US010172481B2

(12) United States Patent
Walker et al.

(10) Patent No.: US 10,172,481 B2
(45) Date of Patent: Jan. 8, 2019

(54) SELECTIVELY LOCKING MERCHANDISING MEMBER

(71) Applicant: Fasteners for Retail, Inc., Twinsburg, OH (US)

(72) Inventors: William H. Walker, Fairlawn, OH (US); Gregory M. Bird, Solon, OH (US); Shane Obitts, Elyria, OH (US); Thaddeus Brej, Rocky River, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 15/689,779

(22) Filed: Aug. 29, 2017

(65) Prior Publication Data

US 2018/0042402 A1 Feb. 15, 2018

Related U.S. Application Data

(63) Continuation of application No. 15/076,329, filed on Mar. 21, 2016, now Pat. No. 9,770,121.
(Continued)

(51) Int. Cl.
*A47F 1/12* (2006.01)
*A47F 5/00* (2006.01)
(Continued)

(52) U.S. Cl.
CPC ..... *A47F 1/125* (2013.01); *A47B 57/58* (2013.01); *A47B 57/583* (2013.01);
(Continued)

(58) Field of Classification Search
CPC ..... F25D 25/02; F25D 25/027; B65G 1/07; B65G 1/08; B65G 1/06; B65G 1/10;
(Continued)

(56) References Cited

U.S. PATENT DOCUMENTS 4,905,847 A * 3/1990 Hanson ..... A47B 57/58 211/184
5,657,702 A * 8/1997 Ribeyrolles ..... A47B 57/585 108/61
(Continued)

FOREIGN PATENT DOCUMENTS

EP 1514493 B1 4/2007
EP 1617745 B1 8/2007
(Continued)

OTHER PUBLICATIONS

U.S. Patent and Trademark Office Non-Final Office Action dated Feb. 10, 2017, relating to U.S. Appl. No. 15/076,329.

*Primary Examiner* — Jennifer E. Novosad
(74) *Attorney, Agent, or Firm* — Honigman Miller Schwartz and Cohn LLP

(57) ABSTRACT

A merchandising system includes an elongated mounting member having a wall with at least one tooth and a cooperating member having a front end receivable on the mounting member. The cooperating member can include a slot defined in the front end. A lock is received in the slot. The lock includes at least one tooth located at a first end and a resilient member located at a second end. The lock can selectively engage the mounting member so as to retard or permit a lateral movement of the cooperating member in relation to the mounting member.

22 Claims, 9 Drawing Sheets

Related U.S. Application Data

(60) Provisional application No. 62/144,672, filed on Apr. 8, 2015.

(51) Int. Cl.
*A47F 7/28* (2006.01)
*A47B 57/58* (2006.01)

(52) U.S. Cl.
CPC ..... *A47B 57/585* (2013.01); *A47F 5/005* (2013.01); *A47F 7/28* (2013.01)

(58) Field of Classification Search
CPC ..... B65D 83/00; A47B 57/58; A47B 57/583; A47B 57/585; A47B 57/586; A47B 57/588; E05B 73/00; E05B 3/00; E05B 69/006; A47F 1/126; A47F 1/125; A47F 1/04; A47F 7/17; A47F 1/06; A47F 1/08; A47F 1/12; A47F 3/02; A47F 1/10; A47F 1/03; A47F 5/005; A47F 3/14; A47F 7/28; A47F 5/0068; A47F 5/16; A47F 5/0018; A47F 5/0025; A47F 5/0043; A47F 7/024; A47F 7/0246
USPC ..... 211/59.3, 59.2, 119.003, 184, 4, 211/90.01–90.04, 150, 175; 108/60, 61, 108/71, 6; 312/126, 35, 61, 71, 128, 131, 312/132, 137; 221/227, 255, 279, 75, 76, 221/90, 242, 226, 229, 231, 232
See application file for complete search history.

(56) References Cited

U.S. PATENT DOCUMENTS 6,047,647 A * 4/2000 Laraia, Jr. ..... A47B 57/58 108/61
6,227,385 B1 * 5/2001 Nickerson ..... A47F 1/126 108/61
6,357,606 B1 * 3/2002 Henry ..... A47F 1/126 211/184
6,823,997 B2 * 11/2004 Linden ..... A47F 5/005 211/175
6,964,235 B2 * 11/2005 Hardy ..... A47F 1/126 108/61
7,216,770 B2 * 5/2007 Mueller ..... A47F 1/126 211/59.3
7,395,938 B2 * 7/2008 Merit ..... A47F 5/005 211/184
7,641,057 B2 * 1/2010 Mueller ..... A47F 1/126 206/221
7,681,744 B2 * 3/2010 Johnson ..... A47F 1/126 211/59.3
8,177,076 B2 * 5/2012 Rataiczak, III ..... A47F 1/126 211/59.3
8,267,258 B2 * 9/2012 Allwright ..... B65H 1/00 211/59.3
8,317,038 B2 * 11/2012 Luberto ..... A47F 1/126 211/59.3
8,342,340 B2 1/2013 Rataiczak, III et al.
8,627,965 B2 * 1/2014 Hardy ..... A47F 1/126 211/184
8,739,984 B2 * 6/2014 Hardy ..... A47F 1/126 211/119.003
8,746,468 B2 * 6/2014 Poulokefalos ..... A47F 5/005 211/59.3
8,752,717 B2 * 6/2014 Bird ..... A47F 1/04 211/184
8,967,394 B2 * 3/2015 Hardy ..... A47F 1/126 211/175
8,978,904 B2 * 3/2015 Hardy ..... A47F 1/126 211/184
9,173,505 B2 11/2015 Hardy
9,259,102 B2 * 2/2016 Hardy ..... A47F 1/04
9,289,078 B2 * 3/2016 Hardy ..... A47F 1/12
9,357,841 B2 * 6/2016 Obitts ..... A47F 5/005
9,770,121 B2 * 9/2017 Walker ..... A47F 1/125
2002/0170866 A1 * 11/2002 Johnson ..... A47F 1/126 211/59.3
2007/0090068 A1 * 4/2007 Hardy ..... A47F 1/126 211/59.3
2007/0138114 A1 * 6/2007 Dumontet ..... A47F 1/126 211/59.3
2008/0156752 A1 * 7/2008 Bryson ..... A47F 1/126 211/59.3
2010/0089847 A1 * 4/2010 Rataiczak, III ..... A47F 1/126 211/59.3
2012/0006773 A1 * 1/2012 Mueller ..... A47F 1/126 211/59.3
2012/0111813 A1 * 5/2012 Hardy ..... A47F 1/126 211/59.3
2013/0270204 A1 * 10/2013 Bird ..... A47F 1/04 211/59.3
2014/0217042 A1 * 8/2014 Hardy ..... A47F 1/126 211/59.2
2014/0263133 A1 * 9/2014 Walker ..... A47F 5/005 211/184
2014/0263134 A1 * 9/2014 Walker ..... A47F 5/005 211/184
2014/0299560 A1 * 10/2014 Kim ..... A47F 1/126 211/59.2
2014/0326690 A1 11/2014 Hardy
2014/0326691 A1 11/2014 Hardy
2015/0208830 A1 * 7/2015 Hardy ..... A47F 1/126 211/59.3
2015/0359358 A1 * 12/2015 Miller, Jr. ..... A47F 5/005 211/59.2
2016/0081491 A1 3/2016 Hardy
2016/0088935 A1 * 3/2016 Brej ..... A47F 1/126 211/126.6
2018/0042402 A1 * 2/2018 Walker ..... A47F 1/125

FOREIGN PATENT DOCUMENTS

WO WO-0197660 A1 12/2001
WO WO-2007073294 A1 6/2007

* cited by examiner

SELECTIVELY LOCKING MERCHANDISING MEMBER

This application is a continuation of, and claims priority under 35 U.S.C. § 120 from, U.S. patent application Ser. No. 15/076,329, filed on Mar. 21, 2016, which claims the benefit of Provisional Application Ser. No. 62/144,672 which was filed on Apr. 8, 2015. The entire contents of these applications are incorporated hereinto by reference.

BACKGROUND

The present disclosure pertains to a merchandising system. More specifically, the disclosure relates to a base and divider assembly employed in a forward feeding display merchandising system for storing and displaying merchandise of a variety of shapes and sizes and automatically delivering the merchandise to the front of a shelf. More particularly, the disclosure pertains to a cooperating member, such as a divider or track which can be selectively locked to a front rail or mounting member of the merchandising system.

Shelving is used extensively for stocking and storing products or merchandise in a variety of stores, such as grocery stores, drug stores and mass merchandisers, such as Walmart, Kmart and the like. Most consumer product stores contain fixed shelving which is arranged back to back between aisleways, on which shelving merchandise is stocked. It is desirable for merchandise to be displayed at the front edge of the shelf so that the customer can see the merchandise and be induced to purchase such merchandise. In such stores, if the shelves are not positioned at eye level, it is difficult for the customer to see the items being displayed, if the items are not located adjacent the front edge of the shelf. Also, fixed shelves make it difficult to rotate product, i.e., move the older stock to the front of the shelf and position newer stock behind the older stock. Rotating products is an important consideration if the goods are perishable or subject to becoming stale (cigarettes, fruit juices, dairy products and the like fall into this category). It is important for such articles that they be removed following a first in, first out system to maintain freshness.

Forward feed devices are employed to automatically move an item forward on a shelf, as the item before it in a column of merchandise is removed from the shelf. These devices generally fall into three categories. The first category pertains to inclined tracks which rely on gravity to feed, slide, or roll products forward on the shelf. Gravity feeding, however, may be unpredictable in that various materials or packages slide more easily than others because of different weights and frictional interfaces between the products and the track. The second category employs conveyor belts which still use gravity to effect forward movement. These devices are typically cumbersome, expensive and complicated due to the need to properly tension the track and the conveyor belts. The third category uses spring biased pusher paddles to feed the product forward. Such paddle based forward feed devices have become very popular and have been found useful for a variety of merchandise.

In the third category, separate dividers and tracks containing pusher paddles are usually employed, along with end dividers to separate the merchandise into columns. It has been considered advantageous to provide an integrated track and divider system because such an integrated track and divider makes assembly of the merchandising system on a shelf easier for store personnel as there are less components to handle. However, an integrated track and divider is disadvantageous from the perspective that the divider cannot be removed from the track should that become necessary. In some circumstances, such as for wide products, a drop in track is desired so that two pusher paddles urge the merchandise forward. Currently, a separate track has to be produced for this purpose.

It would be desirable to automatically lock a divider to a front rail in order to retard the sideward or lateral movement of one or more dividers as product is being pushed forward on the track by the spring biased pusher paddles. In other words, it would be desirable to allow the divider to automatically engage the front rail in such a way that the divider is retarded from such sliding movement in one end position of the locking assembly but is allowed to slide sideways in relation to the front rail in another end position of the locking assembly. Ideally, the divider would be movable in a lateral direction parallel to the front rail while being secured in a direction perpendicular to the front rail when a locking member is disengaged but the divider would resist movement in the lateral direction parallel to the front rail and would remain secured in a direction perpendicular to the front rail when the locking member is engaged. It may be advantageous to provide tracks with such a feature as well.

BRIEF SUMMARY OF THE DISCLOSURE

In accordance with one embodiment of the present disclosure, a merchandising system comprises an elongated mounting member including a wall, the wall comprising at least one tooth and a cooperating member including a front end. The front end is adapted to be received on the mounting member and is adapted to selectively engage the wall thereof. The cooperating member includes a chamber accessible through a slot defined in the front end of the cooperating member. A lock is received in the slot. The lock includes at least one tooth located at a first end and a resilient member located at a second end, wherein the resilient member is adapted to bias the at least one tooth of the lock into engagement with the at least one tooth of the mounting member so as to retard a lateral movement of the cooperating member in relation to the mounting member. The lock is linearly movable relative to a cooperating member against a bias of the resilient member in order to selectively disengage the lock at least one tooth from the at least one tooth of the cooperating member thereby permitting a lateral movement of the cooperating member in relation to the mounting member.

In accordance with another embodiment of the present disclosure, a merchandising system comprises an elongated mounting member, including a longitudinal axis, the mounting member including a front wall, a back wall and a channel defined between the front wall and the back wall, the front wall including a plurality of spaced teeth. A cooperating member includes an elongated body which is oriented in a direction generally transverse to the mounting member longitudinal axis. The cooperating member includes a front end, wherein at least a portion of the cooperating member front end is received in the channel of the mounting member and wherein the front end comprises a chamber accessible via a slot defined in the front end. A lock is received in the slot and is mounted to the cooperating member. The lock includes a first end comprising a plurality of spaced teeth and a second end comprising a biasing member adapted for biasing the lock forwardly in the chamber. The plurality of spaced teeth of the elongated mounting member selectively engages the plurality of spaced teeth of the lock to retard a lateral movement of the cooperating member in relation to the mounting member. The plurality of spaced teeth of the mounting member are disengaged from the plurality of spaced teeth of the lock when the lock is slid rearwardly away from the cooperating member front end against the bias of the biasing member thereby permitting the lateral movement of the cooperating member in relation to the mounting member.

In accordance with still another embodiment of the present disclosure, there is provided a merchandising system which comprises an elongated mounting member including a first engaging member and a cooperating member configured to attach to the mounting member, the cooperating member including a front end comprising a second engaging member. A third engaging member is mounted to the cooperating member, wherein the third engaging member is adapted to move linearly along a longitudinal axis of the cooperating member from an extended position to a retracted position. The third engaging member comprises a first end including an engaging element for selectively engaging a surface of the mounting member and a second end comprising a biasing member for biasing the third engaging member to the extended position in order to retard a movement of the cooperating member in a lateral direction parallel to a longitudinal axis of the mounting member. The third engaging member also includes a tab extending over the mounting member. The tab is adapted to be manually contacted for pushing the third engaging member into a retracted position against the bias of the biasing member.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

Figure 1:
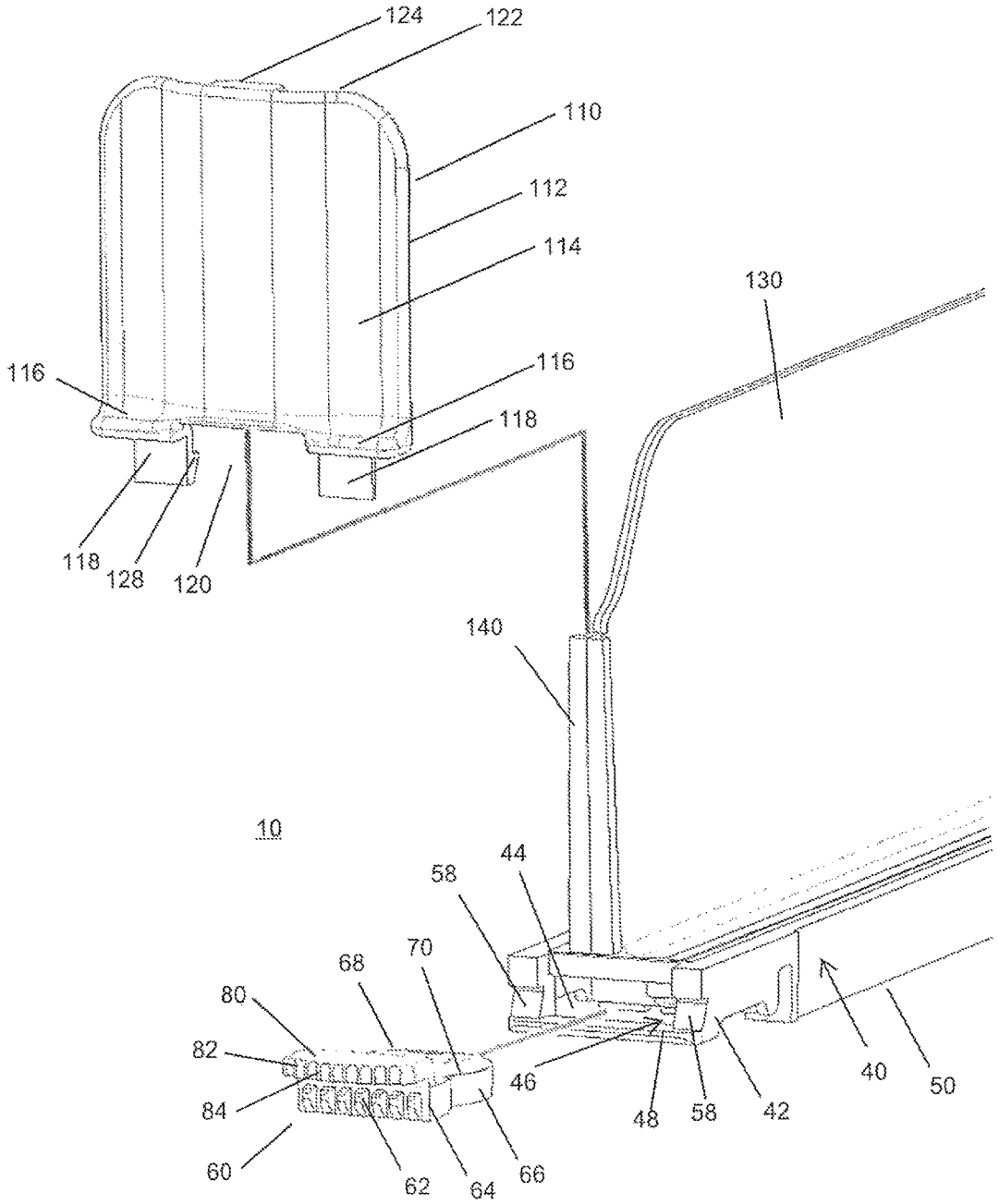
FIG. 1 is an exploded perspective view of a base and divider assembly of a merchandising system which constitutes one embodiment of a cooperating member according to the present disclosure, showing an elongated base and divider, a lock and a front wall.
Figure 2:
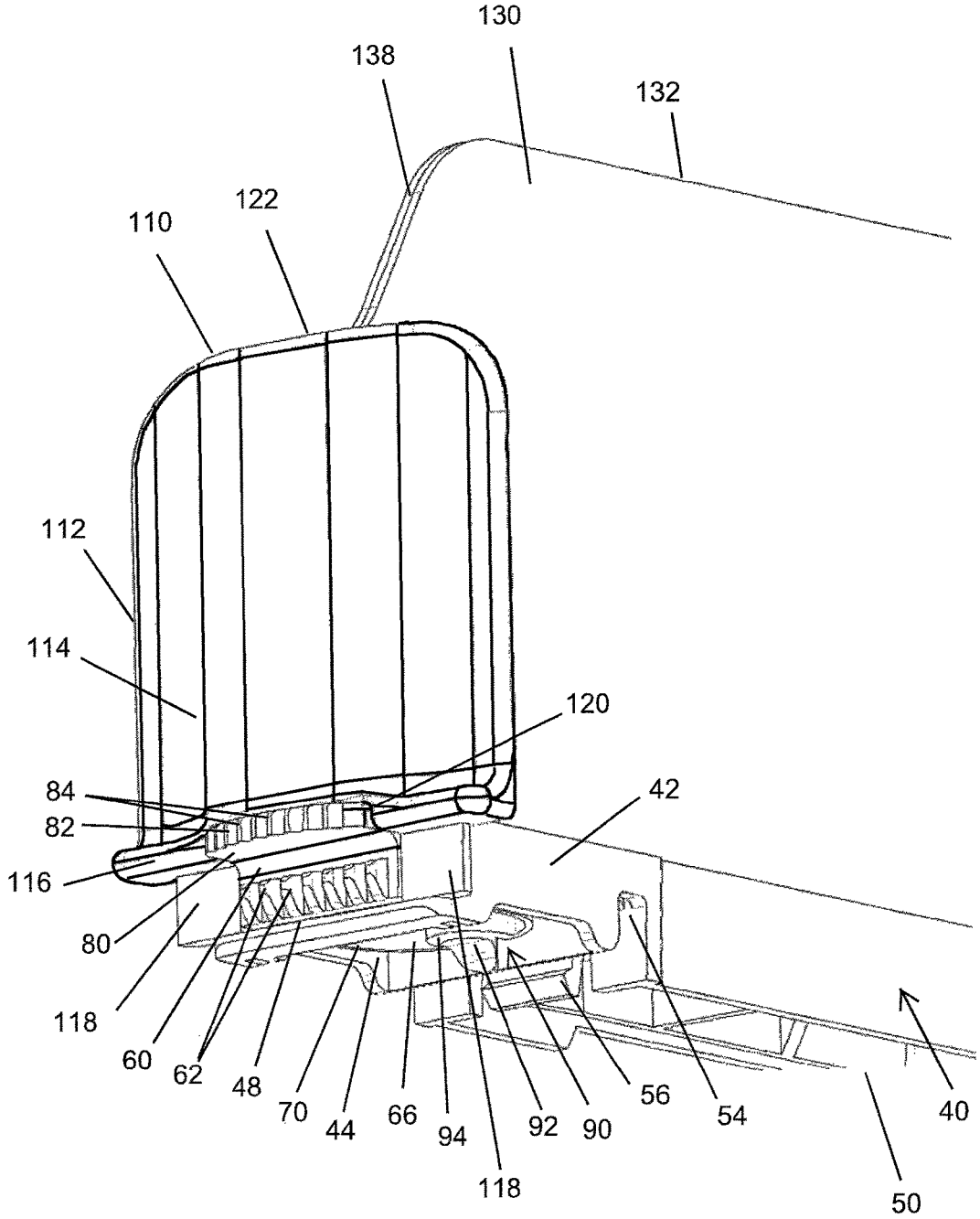
FIG. 2 is an assembled perspective view of the cooperating member of FIG. 1.

Referring now to the drawings wherein the showings are for purposes of illustrating several embodiments of the disclosure only, FIG. 1 shows a merchandising system 10 which includes a cooperating member 40 comprising a base 50. A divider 130 can be either selectively or permanently mounted on or secured to the base 50. The cooperating member 40 includes a front end 42 in which a slot 46 is defined. The slot 46 provides access to a chamber 44 defined in the base 50. As best seen in FIG. 2, located behind the chamber 44 is a groove 54 defined in the base 50. The groove 54 which is defined in the walls of the base 50 can comprise an engaging element or member. At least a portion of groove 54 can be defined by at least one resilient tab member 56.

A lock 60 can be received in the slot 46 and selectively mounted within the chamber 44. At least one body 58 borders the slot 46 and retards the lock 60 from moving laterally in relation to the base 50. Also, a wall 48 can extend beneath the slot 46. In one embodiment, the lock 60 includes at least one tooth 62 located at a first or front end 64 thereof. Alternatively, a plurality of spaced teeth 62 can be provided on the first end 64. A resilient biasing member 66 is located at a second or rear end 68 of the lock 60. The resilient member 66 can comprise a generally ring-shaped element 70. The element 70 is resilient due to the resilient nature of the material from which the lock 60 is made, such as a known thermoplastic. A tab or plateau-like portion 80 can also be defined on the first end 64 of the lock. Tab 80 includes a front face 82 adapted for manual contact by digits of users such as store personnel. Defined in the front face 82 are a plurality of spaced ridges 84 which can aid in pushing the tab 80 during manual contact thereof. As is evident from FIGS. 3A, 38B, and 7, cooperating member 40 with lock 60 can be received on an elongated mounting member 20, sometimes termed a front rail. Cooperating member 40 is oriented in a direction generally transverse to a longitudinal axis of the elongated mounting member 20.

It should be appreciated that while particular designs of teeth 24 and 62 are illustrated, any suitable types of engaging elements can be employed for this purpose. In other words, differently shaped teeth can be provided. In the embodiments illustrated, the teeth are shown as generally being trapezoidal in shape. If so desired, the shapes of the teeth can be rounded, or teeth 62 can be rounded while teeth 24 can have a different shape, such as a trapezoid or a rectangle.

Figure 7:
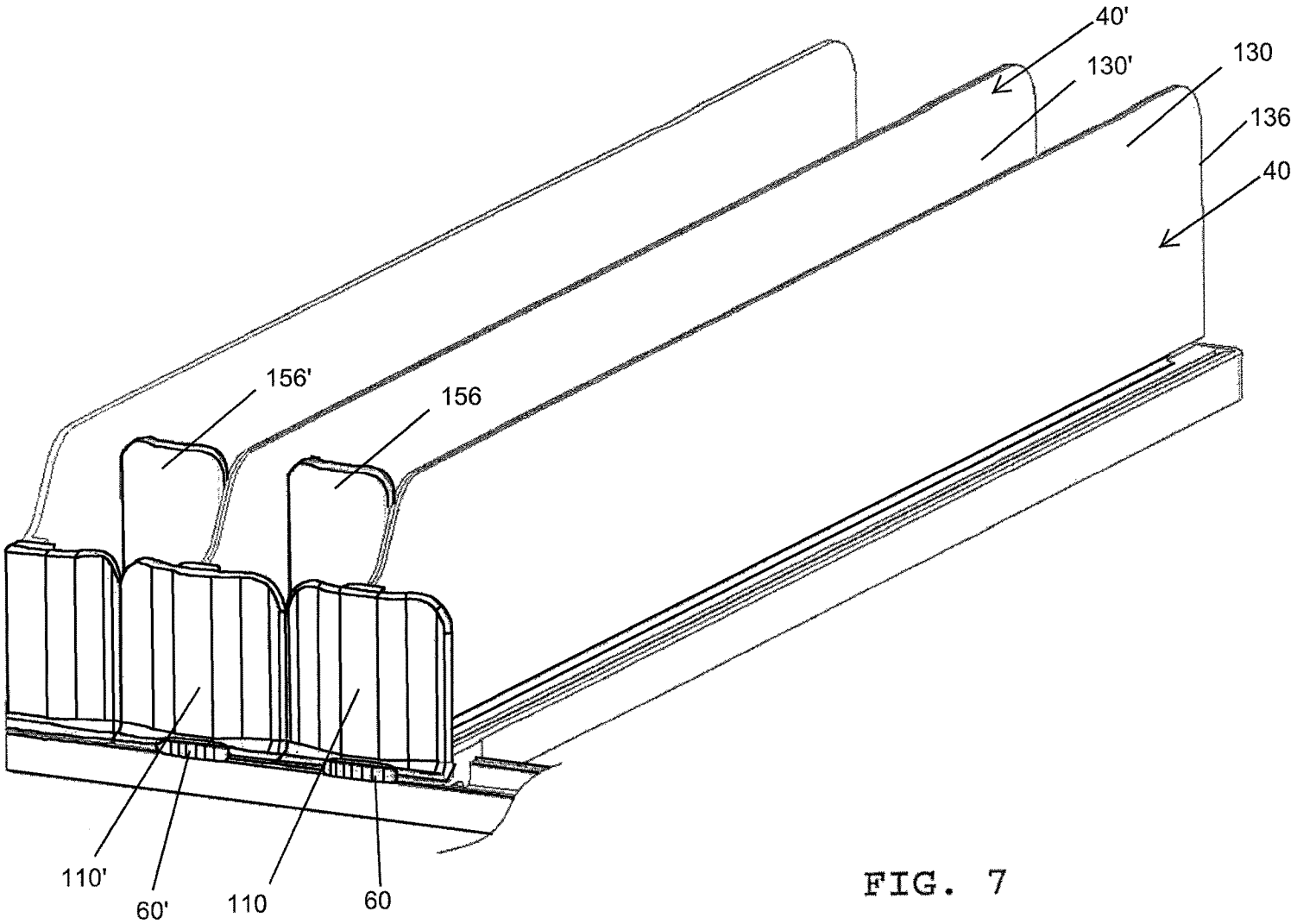
FIG. 7 is a reduced perspective view of the merchandising system according to FIGS. 3A and 3B including several cooperating members located in a side by side relationship as they would be when mounted on a subjacent shelf (not shown) with an elongated mounting member, and illustrating the use of a track positioned between two cooperating members.

Referring again to FIG. 2, in one embodiment the divider 130 can comprise a top portion 132 and a front portion 138. With reference now also to FIG. 7, the divider 130 also comprises a rear portion 136. In one embodiment, a locking feature can be provided for selectively securing the divider 130 to the base 50. Further information concerning the locking feature can be found in U.S. Pat. No. 8,752,717 issued on Jun. 17, 2014, the subject matter of that patent is incorporated hereinto by reference in its entirety. It should be appreciated that there are also other types of connecting structures which can selectively connect a base and a divider to each other, but which allow the base to be separated from the divider when the divider is not needed. Due to the resiliency of the thermoplastic material from which at least one of the divider 130 and the base 50 are made, the divider can be selectively separated from the base and be selectively connected thereto any desired number of times within reason. If desired, a snap fit can be provided between the base 50 and the divider 130. Alternatively, the divider 130 and base 50 can be of one piece.

Figure 8:
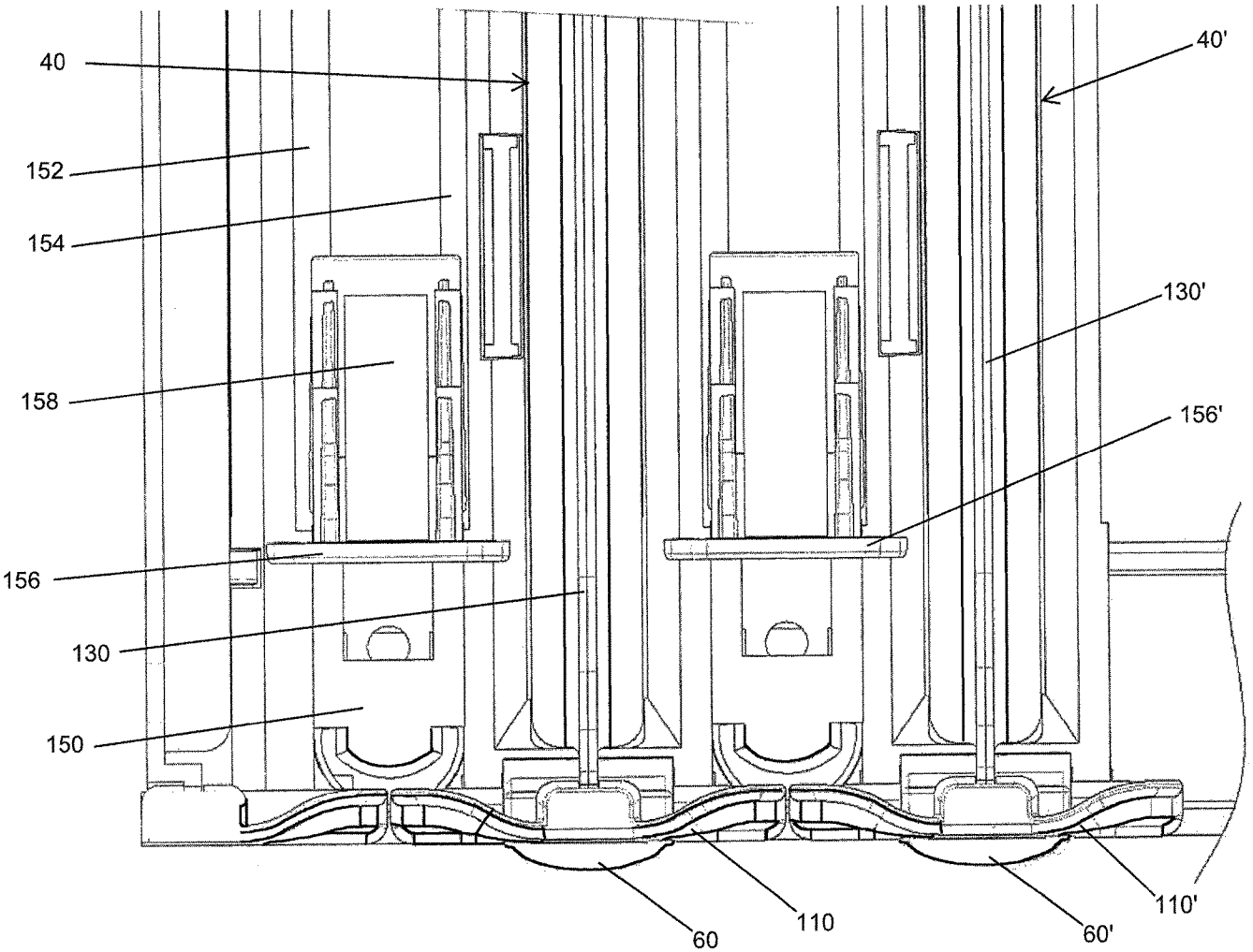
FIG. 8 is an enlarged top plan view of the merchandising system of FIG. 7.

While one embodiment of a cooperating member 40 is illustrated in FIG. 1, namely a divider, it should be appreciated that the cooperating member could, instead be a free-standing pusher track, such as track 150 illustrated in FIGS. 7 and 8. Alternatively, a combination track and divider assembly could be provided.

With reference now to FIG. 8, located on a top surface of the cooperating member or track 150 can be first and second spaced rails 152 and 154. These slidably accommodate a pusher 156 which is mounted on the rails. The pusher 156 can be urged forwardly on the rails by a coil spring 158 or like biasing member. The operation of a coil spring for urging a pusher assembly forward on a track is well known in the art.

Figure 9:
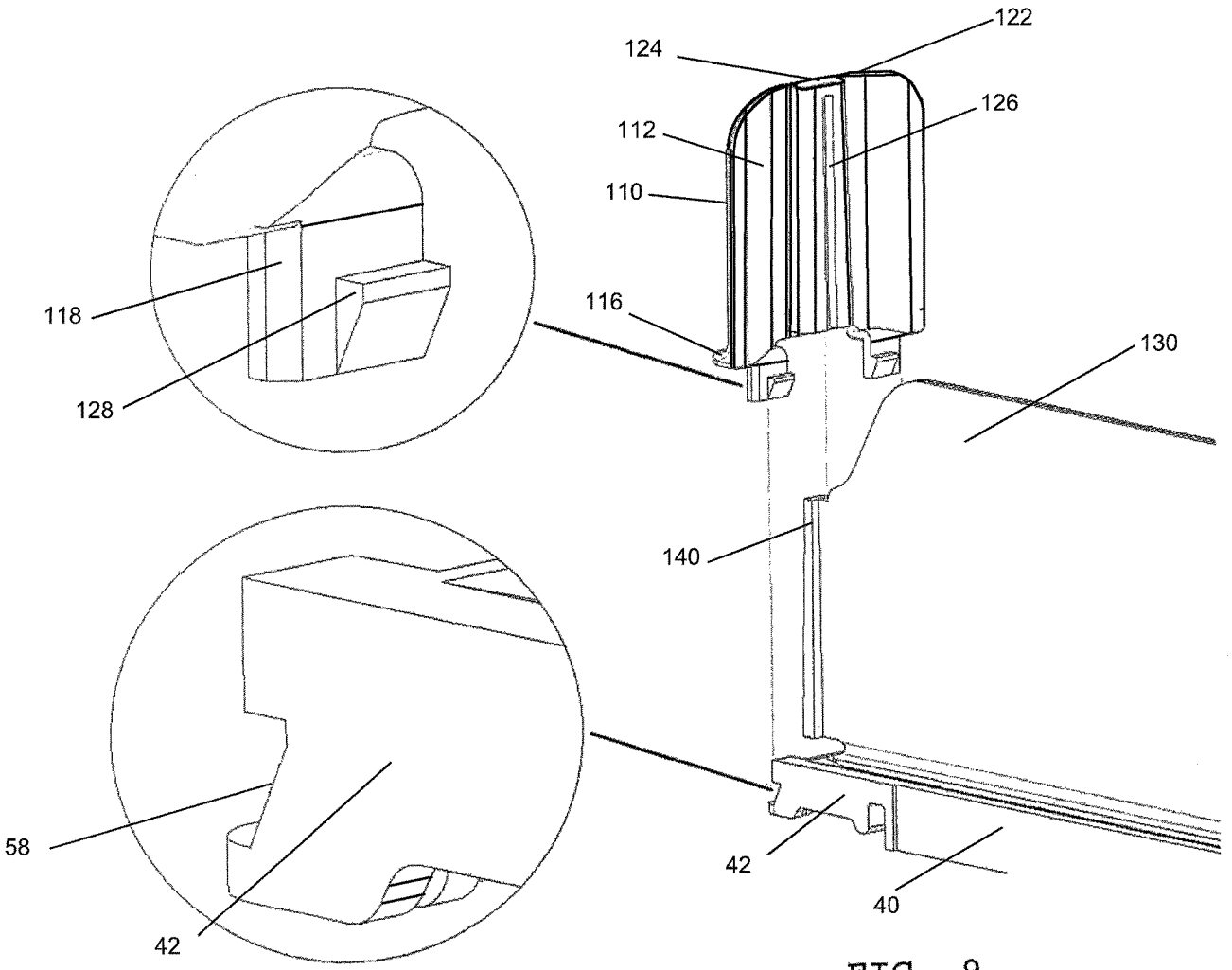
FIG. 9 is an exploded perspective view of a base and divider assembly of a merchandising system showing the engaging element for locking a front wall to the cooperating member of the present disclosure.

With reference once more to FIG. 1, defined on the front portion 138 of the divider 130 is a first engaging portion which can be in the form of a flange or shoulder section 140. Shoulder section 140 can accommodate a front wall 110 which is oriented generally transverse to the longitudinal axis of the divider 130, as is evident from FIG. 7. The front wall 110 can be in the form of a laterally extending support section or body 112. Defined on a rear face of the front wall 110 is housing 124. A vertically oriented slot 126 can extend in the housing, as best shown in FIG. 9. The slot 126 can be located approximately equidistant between the two side edges of front wall, if so desired. The walls of the housing 124 defining the slot 126 can be considered a second engaging portion, which cooperates with the first engaging portion.

As is evident from FIG. 9, the slot 126 in the housing 124 accommodates the shoulder section 140 of the divider 130. The body 112 of front wall 110 extends laterally in relation to the housing 124. The purpose of the front wall 110 is to provide a retarding wall which can be employed to retard a forward most one of a column of merchandise from falling over the mounting member 20 and off the subjacent shelf. Front wall 110 can also be made from a suitable known plastic material which is transparent, so that the merchandise abutted by the front wall can be seen. It should be appreciated that in order to form the front wall, it can be molded from the suitable known transparent plastic material so that the front wall is of one piece.

With reference to FIG. 2, the body 112 of front wall 110 can be generally planar and comprises a front face 114 from which extends a gripping portion or handle 116, as well as an engaging element or protrusion 118 for locking the front wall to the cooperating member 40. The handle 116 includes a recess 120 for cooperating with the front end 42 of cooperating member 40 to further define slot 46. In one embodiment, the protrusion 118 is spaced from the handle 116, with the protrusion being located beneath the handle. With reference now to FIG. 9, in this regard, front end 42 of cooperating member 40 includes at least one body 58 which can comprise a seat portion for receiving the protrusion 128.

In the orientation illustrated in FIG. 9, the protrusion 118 of the front wall 110 can include a ledge 128 having a sloped portion which contacts the front end 42 of the cooperating member. The sloped portion of ledge 128 urges the protrusion 118 forwardly as it comes into contact with the front end 42 during, for example, a linear downward sliding movement of the front wall 110. Upon further linear downward motion of the front wall 110, the ledge 128 is allowed to retract or snap into the seat portion 58 of the front end of cooperating member. The retraction of the ledge 128 into the seat portion 58 provides a locking engagement of the front wall 110 with the cooperating member 40.

All of the components of the merchandising system, namely, the mounting member 20, cooperating member 40, lock 60, and front wall 110, can be made from suitable known materials such as a variety of known somewhat resilient or flexible thermoplastics although other resilient materials could also be used.

The limits of movement of the front wall 110 can be regulated by the ledge 128 and how it interacts with the front end 42 of the cooperating member. More particularly, the condition or position of the merchandising system illustrated in FIG. 2, front wall 110 is fully engaged with the cooperating member 40 and the ledge 128 fits in the seat portion 58. Further downward movement of the front wall 110 past this position is, thus, prevented or at least retarded.

With reference now again to FIG. 2, cooperating member 40, lock 60, front wall 110, and divider 130 are shown in assembled condition. Lock 60 is shown as being selectively mounted within chamber 40 with tab 80 extending forward from both the slot 46 and the recess 120 of front wall 110. The recess 120 additionally provides access to the tab 80 from the handle 116.

Figure 4A:
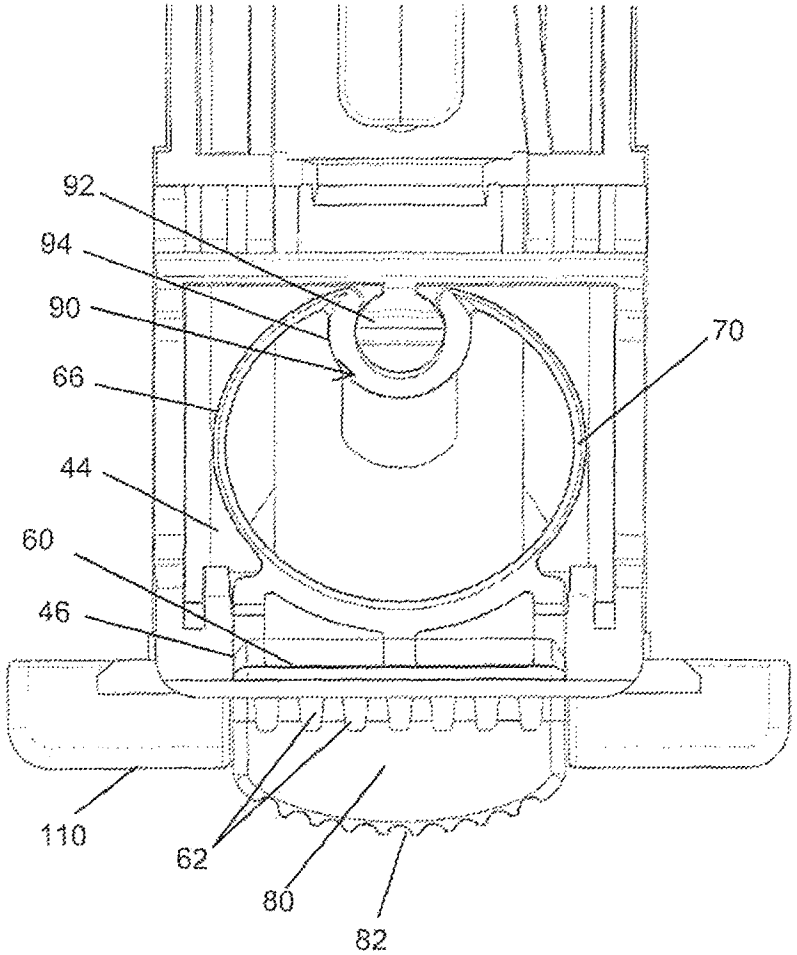
FIG. 4A is a bottom plan view of the cooperating member of FIG. 3A when the lock is in an engaged condition.
Figure 4B:
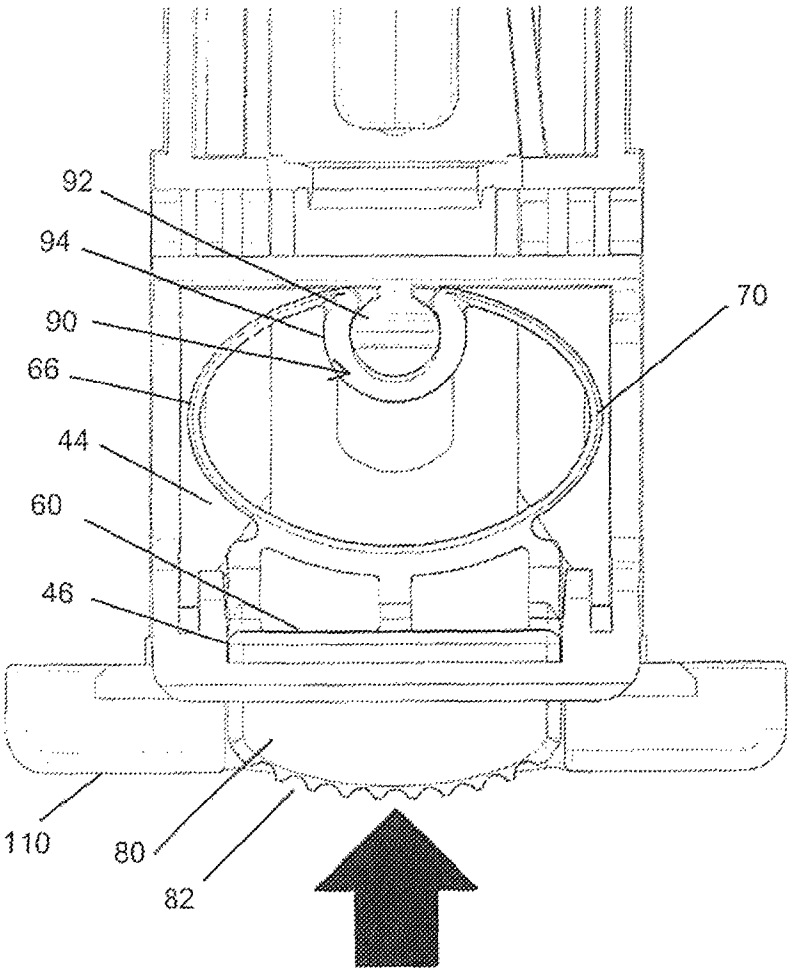
FIG. 4B is a bottom plan view of the cooperating member of FIG. 3B when the lock is in a disengaged condition.
Figure 6:
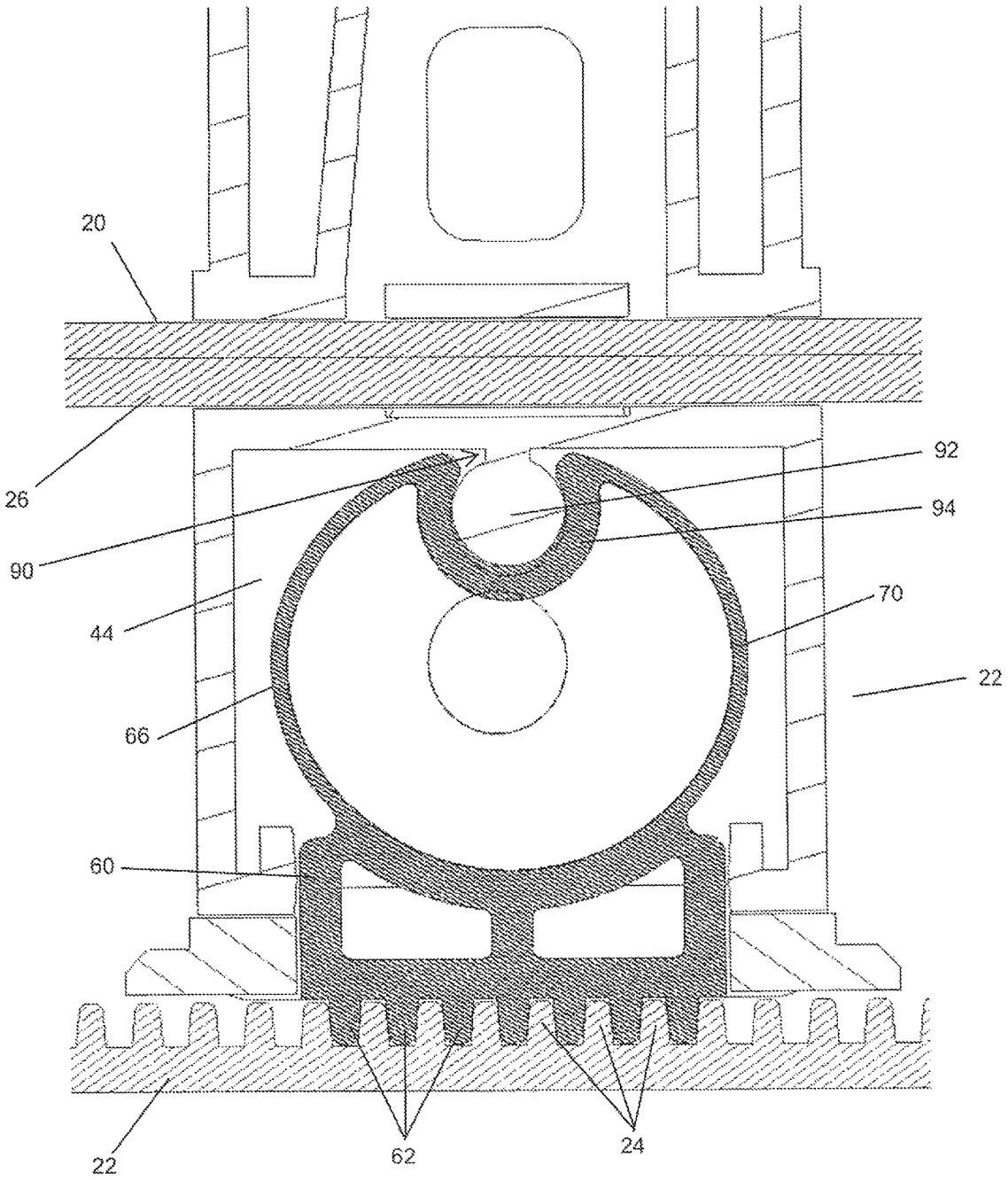
FIG. 6 is an enlarged cross-sectional bottom plan view of the cooperating member and the lock of FIG. 3A when the lock is in an engaged condition.

In one embodiment, a connection system 90 is provided for connecting the lock 60 to the cooperating member 40. As shown in FIGS. 4A and 4B, connection system 90 can include protrusion 92 extending downwardly from the body of the base 50 such that it is located in the chamber 44 defined in the cooperating member 40. A clip 94 can be provided on the second end 68 of lock 60. With reference now also to FIG. 6, in one embodiment the clip 94 can be defined within the resilient ring-shaped element 70 of the lock. The clip 94 selectively mounts to the protrusion 92 in order to hold the lock 60 in the slot 46 of the cooperating member 40.

Figure 5:
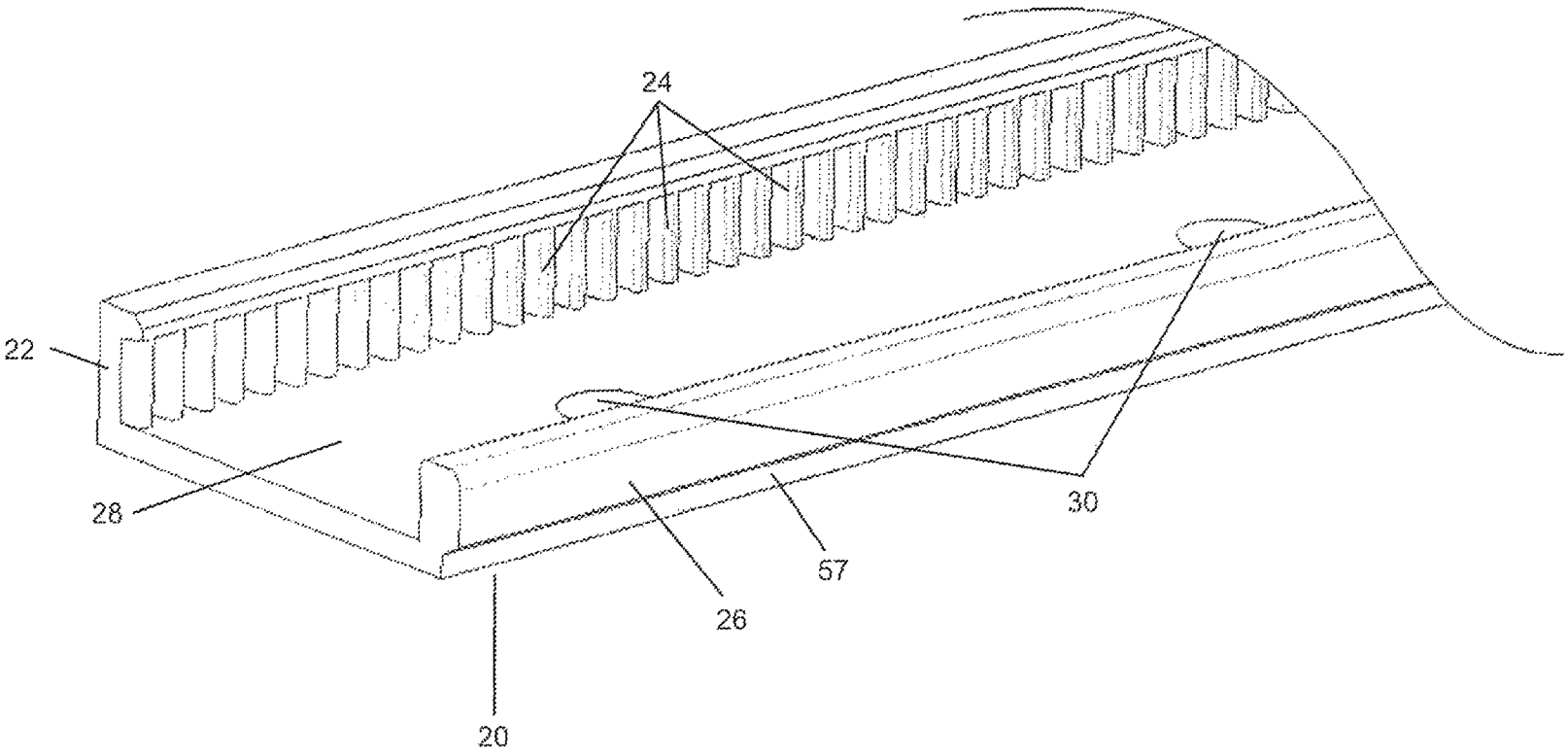
FIG. 5 is an enlarged perspective view of a portion of the mounting member of FIGS. 3A and 3B.

With reference now to FIG. 5, the elongated mounting member or front rail 20 includes a vertically oriented front wall 22, a back wall 26, and a channel 26 defined between the front wall and the back wall. It should be appreciated from FIGS. 3A and 3D, for example, that the back wall 26 of the elongated mounting member or front rail 20 protrudes into the groove 54 defined in the base 50 of the cooperating member 40 when the cooperating member is mounted to the mounting member. Thus, the back wall 26 defines a first engaging member and the slot 56 defines a second engaging member, such that when the first and second engaging members are engaged with each other, a movement of the cooperating member in a direction perpendicular to a longitudinal axis of the mounting member in the plane of such longitudinal axis is retarded, if not entirely prevented.

A suitable conventional fastener (not illustrated) can extend through at least one opening 30 so as to secure the mounting member in place on a subjacent shelf (not illustrated). Such a construction is shown in U.S. Pat. No. 7,216,770 which is dated May 15, 2007. That patent is incorporated herein by reference, in its entirety. Moreover, reference is made to U.S. Pat. No. 8,177,076 which is dated May 15, 2012 for its disclosure of various embodiments of a merchandising assembly. That patent is also incorporated herein by reference, in its entirety. As shown in FIGS. 3A and 5, the tab member 56 engages a groove 57 defined in the rear wall 26 of the mounting member 20.

Defined on a rear face of the front wall 22 of the mounting member 20 is at least one vertically oriented tooth 24. In one embodiment, a plurality of spaced teeth 24 can be provided. As shown in FIG. 3A, the front end 42 of cooperating member 40 is adapted to be received behind the front wall 22 of the mounting member 20. Thus, at least a portion of the front end 42 can be received in the channel 26 of the mounting member 20. As can further be seen from FIGS. 3A and 3B, when front end 42 is received in channel 26, the front wall 22 of the mounting member 20 extends in front of the slot 46 of cooperating member 40 and the back wall 26 is located inside the groove 54 of cooperating member. The chamber 44 is thus located between the front wall 22 and the back wall 26 and within channel 28. The at least one tooth 24 defined in the front wall 22 of the mounting member 20 engages the at least one tooth 62 of the lock 60, which is mounted within chamber 44. The at least one resilient tab portion 56 of groove 54 locks the back wall 26 of mounting member within the groove. If desired, a snap fit can be provided between the tab 56 and the back wall 26. The protrusion 80 mounted on lock 60 extends over the front wall 22 such that the front face 82 makes the lock accessible to store personnel from the front wall of the mounting member 20, as can be seen in FIG. 7.

With particular reference to FIG. 3A, the resilient member 66 of lock 60, which can also be termed a third engaging member, is naturally adapted to bias the lock forwardly in chamber 44. This natural bias causes the at least one tooth 62 of the lock 60 to enter grooves defined between the spaced teeth 24 of the mounting member or front rail 20 and come into engagement with a side wall of the at least one tooth 24 of the mounting member. In the embodiment shown, the natural bias causes the plurality of spaced teeth 62 of the lock 60 to come into engagement with the plurality of spaced teeth 24 of the mounting member 20, as best shown in FIG. 6. In the condition or position of the merchandising system illustrated in FIG. 3A, the cooperating member 40 is retarded from, and preferably prevented from, movement laterally in relation to the mounting member 20.

It should be appreciated that the resilient member 66 allows the lock 60 to be resiliently biased into contact with the front wall teeth 24, due to the inherent resilient nature of the thermoplastic material from which the lock can be made. However, it should be appreciated that the lock could also be made from other suitable materials, such as various metals or the like. It should thus be appreciated that the lock could be made from a different material than the cooperating member or the mounting member. In addition, various sections of the lock could be made from different materials, if so desired. For example, the resilient member 66 could be made from a more resilient material than the tab 80.

Figure 3B:
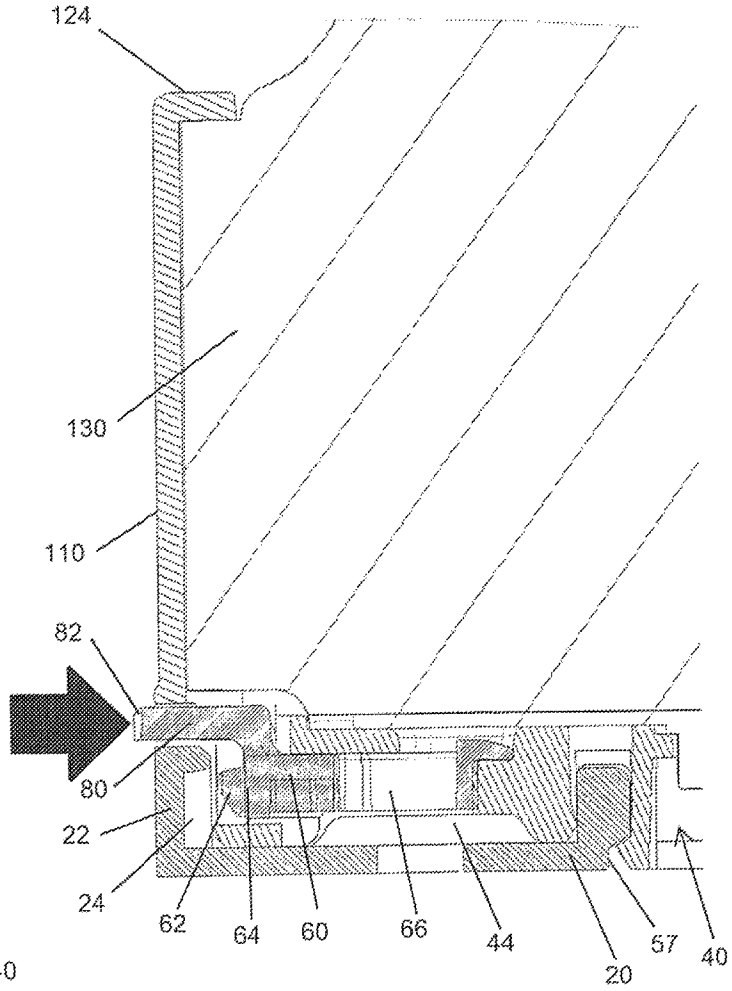
FIG. 3B is an assembled view of the merchandising system of FIG. 3A illustrating permissible movement of the lock in relation to the mounting member when it is desired that the lock be in a disengaged condition such that the resilient member is compressed.
Figure 3A:
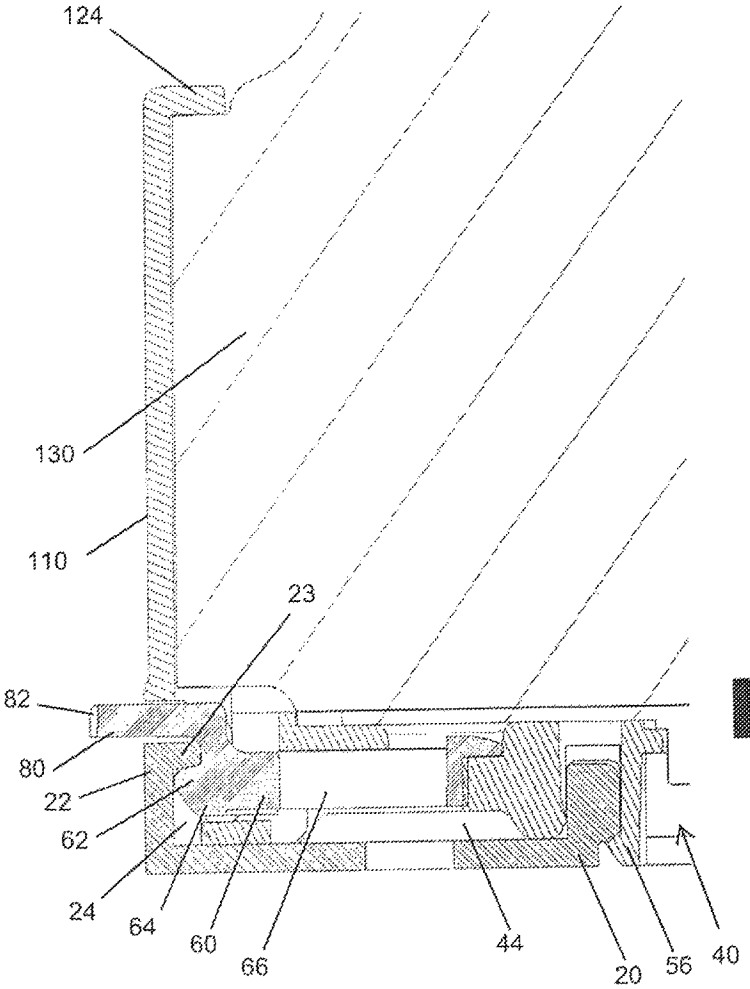
FIG. 3A is an enlarged cross-sectional side view of the cooperating member of FIG. 2 mounted on a mounting member and illustrating an engaged condition of the lock with the mounting member when a resilient member of the lock is in its natural biasing position.

With reference now to FIG. 3B, the tab 80 of lock 60 is shown as being urged in a direction counter to the natural bias of the resilient member 66, as indicated by the arrow. A finger or digit of store personnel pushing on the tab can accomplish this action. It should be appreciated that the movement of the lock 60 is a linear movement. More particularly, the lock is slid rearwardly away from the mounting member and in a direction which is axially aligned with the longitudinal axis of the cooperating member. This counter bias causes the at least one tooth 62 of the lock 60 to disengage from the at least one tooth 24 of the mounting member 20 such that the first end 64 of the lock is spaced away from the front wall 22 of the mounting member. Once this is done, the plurality of spaced teeth 62 of the lock 60 disengage from the plurality of spaced teeth 24 of the mounting member 20 such that the first end 64 of the lock is spaced away from the front wall 22 of the mounting member.

In the condition or position of the merchandising system illustrated in FIG. 3B, the cooperating member 40 is allowed to move laterally, such as via a sliding motion, in relation to the mounting member 20. However, when the tab 80 of lock 60 is no longer being contacted, as shown in FIG. 3A, the resilient member 66 automatically biases the at least one tooth or teeth 62 of the lock to re-engage the at least one tooth or teeth 24 of the mounting member. Thus, any further lateral or sideways movement of the cooperating member in relation to the mounting member is prevented or at least retarded. The locking engagement of the plurality of spaced teeth 62 of lock 60 with the plurality of spaced teeth 24 of mounting member 20 is best shown in FIG. 6.

The cooperating member is allowed to slide laterally in relation to the mounting member in the condition or position of the merchandising system illustrated in FIG. 3B. However, the engagement of the cooperating member with the mounting member, via the resilient tab member 56 of groove 54 accommodating the back wall 26 of mounting member 20, retards the cooperating member from moving in a direction perpendicular to the mounting member regardless of whether lateral movement is permitted. Thus, the cooperating member is retarded from a movement perpendicular to the longitudinal axis of the mounting member, both in a direction rearwardly on the shelf away from the mounting member and in a direction upwardly away from the shelf and the mounting member, even when a lateral movement is permitted for the cooperating member, that is, a movement parallel to the longitudinal axis of the mounting member.

However, when the one or more teeth 62 and 24 are disengaged, the cooperating member 40 can be lifted vertically away from the mounting member 20 and removed from the merchandising assembly by snapping the tooth or protrusion 56 out of groove 57. But, when the one or more teeth 62 and 24 are engaged, such vertical movement of the cooperating member 40 is retarded if not prevented by the engagement of the one or more teeth 62 with a flange 23 which extends rearwardly from the front wall 22 of the mounting member 20 and over the teeth 24, as can be seen from FIG. 3A.

The orientation illustrated in FIG. 4A corresponds to the condition or position of the merchandising system illustrated in FIG. 3A, however the mounting member 20 is not shown for simplicity. FIG. 4A shows the resilient member 66 in its natural bias. In other words, the resilient ring-shaped element 70 of resilient member 66 naturally biases the lock 60 forwardly in chamber 44. The front face 82 of tab 80 is shown as being easily accessible from the front wall 110. Connection system 90 includes the protrusion 92 positioned rearward in the chamber 44. A clip 94, located on the resilient member or ring-shaped element 70, enables the lock 60 to be selectively mounted on the protrusion 92 extending into the chamber 44. In other words, the lock 60 can be detached from the cooperating member 40 when so desired. The clip 94 also acts to hold the lock 60 in the slot 46 of the cooperating member when tab 80 is urged in the counter bias direction, as is evident from FIG. 4B.

The orientation illustrated in FIG. 4B corresponds to the condition or position of the merchandising system illustrated in FIG. 3B. Again, mounting member 20 is not shown for simplicity. FIG. 4B shows the tab 80 of lock 60 as being urged in a direction counter to the natural bias of the resilient member 66, as indicated by the arrow. In this condition, the ring-shaped element 70 compresses against the bias of the resilient member 66 such that the lock 60 can be disengaged. The limits of movement or compression of the ring-shaped element 70 can be regulated by the size and shape of the chamber 44. More particularly, connection system 90 acts against the ring-shaped element 70 as it is urged rearward. In addition, the resilient member 66 fits within the chamber 44 and movement past the chamber is, thus, prevented or at least retarded.

As illustrated in FIGS. 7 and 8, a plurality of cooperating members 40 can be located on a shelf in a spaced side-by-side manner so as to allow multiple columns of merchandise to be urged forwardly on a shelf. Moreover, one or more tracks 150 can also be provided. It should be evident from FIG. 8, that cooperating members can include a type which comprises a base on which are defined rails for accommodating a pusher 156. On the other hand, cooperating members, such as at 40' can include types which only comprise a divider portion 130' and do not also include a track located on a base. Disposed between such cooperating members can be one or more tracks 150. In one embodiment, the tracks do not include a divider as disclosed herein, but merely include a pusher assembly 156. In the disclosed embodiment, the tracks do not have a front wall member of the type illustrated in FIGS. 1-4, nor do they have a lock member of the type illustrated in FIGS. 1-4, and 6. Of course, other embodiments of such tracks could include at least one of a front wall and/or a lock if so desired. On the other hand, cooperating member 40' does include such a front wall 110' and lock 60'.

Disclosed has been a merchandising system which comprises an elongated mounting member selectively securable to an associated shelf and a cooperating member received on the mounting member, wherein the cooperating member extends rearwardly over the associated shelf. The mounting member comprises a wall. The cooperating member in one embodiment comprises an elongated body including at least one tooth. The at least one tooth is movably mounted to the cooperating member and selectively engages the wall of the elongated mounting member.

In one embodiment, an elongated mounting member wall comprises at least one tooth which selectively engages the at least one tooth of the cooperating member. The at least one tooth is located on a front end of the cooperating member and is adapted to engage the wall of the mounting member. The cooperating member can include a chamber accessible through a slot defined in the front end.

In one embodiment, a lock is mounted to the cooperating member. The lock includes at least one tooth located at a first end of a lock body and a resilient member located at a second end thereof. The resilient member is adapted to bias the at least one tooth of the lock into engagement with at least one tooth of the mounting member.

If desired, a protrusion can be mounted on the lock which protrusion is accessible from a portion of the cooperating member.

In one embodiment, the mounting member and the lock include a plurality of spaced teeth which are each adapted to selectively engage each other.

A connection system can connect the lock to the cooperating member. In one embodiment, the connection system includes a protrusion located in the slot of the cooperating member and a clip defined on the lock. The clip selectively mounts to the protrusion in order to hold the lock in the slot.

In one embodiment, a front wall is slidably mounted to a divider portion which protrudes from the base portion. If desired, the front wall can be made of a transparent material.

The disclosure has been described with reference to several embodiments. Obviously, modifications and alterations will occur to others upon a reading and understanding of the preceding detailed description. It is intended that the instant disclosure be construed as including all such modifications and alterations insofar as they come within the scope of the appended claims or the equivalents thereof.

The invention claimed is:

1. A merchandising system comprising:

a cooperating member including a front end defining a slot and a chamber accessible through the slot;

a mounting member including a front wall at least partially defining a channel configured to receive the front end of the cooperating member, the front wall having a tooth; and a lock at least partially received in the chamber and at least partially disposed within the channel of the mounting member, the lock including a front end, a tab, and a resilient member, the front end including a tooth configured to selectively engage the tooth of the mounting member to inhibit movement of the cooperating member relative to the mounting member in a first direction, the tab extending from the channel of the mounting member such that urging the tab in a direction counter to a bias of said resilient member disengages the tooth of the lock from the tooth of the mounting member.

2. The merchandising system of claim 1, wherein the tab includes a front face, and wherein the tooth of the lock is disposed rearward of the front face and forward of the resilient member.

3. The merchandising system of claim 2, wherein the front face extends above the tooth of the lock.

4. The merchandising system of claim 1, wherein the front end and the tab collectively define an L-shape.

5. The merchandising system of claim 1, wherein the tab is accessible over the front wall of the mounting member.

6. The merchandising system of claim 1, wherein the front wall of the mounting member includes a rearwardly extending flange.

7. The merchandising system of claim 6, wherein the flange is operable to engage the tooth of the lock to inhibit movement of the cooperating member relative to the mounting member in a second direction.

8. The merchandising system of claim 7, wherein the second direction is perpendicular to the first direction.

9. The merchandising system of claim 7, further comprising a protrusion extending from the cooperating member and adapted to engage the mounting member to inhibit movement of the cooperating member relative to the mounting member in the second direction.

10. The merchandising system of claim 9, wherein the mounting member includes a rear wall defining a groove configured to receive the protrusion.

11. A merchandising system comprising:

a cooperating member including a front end;

a mounting member defining a channel and including a tooth, the channel configured to receive the front end of the cooperating member; and a lock mounted to the cooperating member and at least partially disposed within the channel of the mounting member, the lock adapted to move relative to the cooperating member from an extended position to a retracted position, the lock including a front end, a tab, and a biasing member, the front end including a tooth configured to selectively engage the tooth of the mounting member to inhibit movement of the cooperating member relative to the mounting member in a first direction, the tab extending from the channel of the mounting member and adapted to be manually contacted for pushing the lock into the retracted position against a bias of the biasing member.

12. The merchandising system of claim 11, wherein the tab includes a front face, and wherein the tooth of the lock is disposed rearward of the front face and forward of the biasing member.

13. The merchandising system of claim 12, wherein the front face extends above the tooth of the biasing member.

14. The merchandising system of claim 11, wherein the front end and the tab collectively define an L-shape.

15. The merchandising system of claim 11, wherein the mounting member includes a front wall at least partially defining the channel, and wherein the tab is accessible over the front wall of the mounting member.

16. The merchandising system of claim 11, wherein the mounting member includes a front wall at least partially defining the channel and having a rearwardly extending flange.

17. The merchandising system of claim 16, wherein the flange is operable to engage the tooth of the lock to inhibit movement of the cooperating member relative to the mounting member in a second direction.

18. The merchandising system of claim 17, wherein the second direction is perpendicular to the first direction.

19. The merchandising system of claim 17, further comprising a protrusion extending from the cooperating member and adapted to engage the mounting member to inhibit movement of the cooperating member relative to the mounting member in the second direction.

20. The merchandising system of claim 19, wherein the mounting member includes a rear wall defining a groove configured to receive the protrusion.

21. A merchandising system comprising:

a cooperating member including a front end defining a slot and a chamber accessible through the slot;

a mounting member including a front wall at least partially defining a channel configured to receive the front end of the cooperating member, the front wall having a tooth; and a lock at least partially received in the chamber, the lock including a front end, a tab, and a resilient member, the front end including a tooth configured to selectively engage the tooth of the mounting member to inhibit movement of the cooperating member relative to the mounting member in a first direction, the tab extending from the channel of the mounting member such that urging the tab in a direction counter to a bias of said resilient member disengages the tooth of the lock from the tooth of the mounting member, wherein the front wall of the mounting member includes a rearwardly extending flange operable to engage the tooth of the lock to inhibit movement of the cooperating member relative to the mounting member in a second direction.

22. A merchandising system comprising:

a cooperating member including a front end;

a mounting member defining a channel and including a tooth, the channel configured to receive the front end of the cooperating member; and a lock mounted to the cooperating member and adapted to move relative to the cooperating member from an extended position to a retracted position, the lock including a front end, a tab, and a biasing member, the front end including a tooth configured to selectively engage the tooth of the mounting member to inhibit movement of the cooperating member relative to the mounting member in a first direction, the tab extending from the channel of the mounting member and adapted to be manually contacted for pushing the lock into the retracted position against a bias of the biasing member, wherein the mounting member includes a front wall at least partially defining the channel and having a rearwardly extending flange operable to engage the tooth of the lock to inhibit movement of the cooperating member relative to the mounting member in a second direction.

* * * * *